US008546736B2

(12) United States Patent
Dryer

(10) Patent No.: US 8,546,736 B2
(45) **Date of Patent: *Oct. 1, 2013**

(54) MODULAR GUIDED PROJECTILE

(75) Inventor: Richard Dryer, Oro Valley, AZ (US)

(73) Assignee: Raytheon Company, Waltham, MA (US)

( * ) Notice: Subject to any disclaimer, the term of this patent is extended or adjusted under 35 U.S.C. 154(b) by 343 days.

This patent is subject to a terminal disclaimer.

(21) Appl. No.: 13/109,706

(22) Filed: May 17, 2011

(65) Prior Publication Data

US 2012/0181375 A1 Jul. 19, 2012

Related U.S. Application Data

(63) Continuation-in-part of application No. 11/686,689, filed on Mar. 15, 2007, now Pat. No. 7,947,938.

(51) Int. Cl.
*F41G 7/00* (2006.01)

(52) U.S. Cl.
USPC ..... 244/3.21; 244/3.1

(58) Field of Classification Search
USPC ..... 244/3.1, 3.15, 3.21, 3.22, 73 R, 74, 244/76 J
See application file for complete search history.

(56) References Cited

U.S. PATENT DOCUMENTS

| | | | | |
|---|---|---|---|---|
| 2,976,806 | A * | 3/1961 | Risk et al. | 361/732 |
| 4,051,414 | A * | 9/1977 | Will et al. | 361/802 |
| 4,899,956 | A * | 2/1990 | King et al. | 244/3.21 |
| 5,131,602 | A | 7/1992 | Linick | |
| 5,238,204 | A | 8/1993 | Metz | |
| 5,467,940 | A | 11/1995 | Steuer | |
| 5,507,452 | A * | 4/1996 | Mayersak | 244/3.15 |
| 5,880,396 | A | 3/1999 | Zacharias | |
| 6,198,564 | B1 | 3/2001 | Knight | |
| RE37,331 | E | 8/2001 | Schroeder | |
| 6,347,763 | B1 | 2/2002 | Harkins et al. | |
| 6,685,134 | B2 | 2/2004 | Trosky et al. | |
| 6,889,935 | B2 | 5/2005 | O'Dwyer | |
| 7,506,587 | B1 * | 3/2009 | Anderson | 102/489 |
| 7,947,937 | B1 * | 5/2011 | Langner | 244/3.16 |
| 2003/0071166 | A1 | 4/2003 | Moore et al. | |
| 2004/0108412 | A1 | 6/2004 | Moore et al. | |
| 2004/0144888 | A1 | 7/2004 | Dryer et al. | |
| 2005/0082419 | A1 | 4/2005 | Dryer et al. | |
| 2005/0103925 | A1 | 5/2005 | Folsom et al. | |
| 2005/0253017 | A1 | 11/2005 | Kongelbeck et al. | |

OTHER PUBLICATIONS

ISA/US, International Search Report for Application No. PCT/US2008/056123, Mail Date Jul. 28, 2008.

* cited by examiner

*Primary Examiner* — Tien Dinh
*Assistant Examiner* — Michael Kreiner
(74) *Attorney, Agent, or Firm* — Eric A. Gifford

(57) ABSTRACT

A modular artillery projectile and method of engaging a target. A modular artillery projectile may include a payload module, a guidance module coupled to the payload module and a rear module coupled to the guidance module. The payload module may be selected from a plurality of interchangeable payload modules containing different payloads. The guidance module may include a transverse propulsion system to propel the modular artillery projectile transversely to a longitudinal axis of the modular artillery projectile, a global positioning system receiver, and a control system to control the transverse propulsion system responsive to the global positioning system receiver to guide the modular artillery projectile to a predetermined target position.

16 Claims, 7 Drawing Sheets

MODULAR GUIDED PROJECTILE

RELATED APPLICATION INFORMATION

This patent is a continuation-in-part of the following prior-filed copending non-provisional patent application: application Ser. No. 11/686,689, entitled Methods and Apparatus for Projectile Guidance, filed Mar. 15, 2007.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to artillery munitions and particularly to guided artillery projectiles.

2. Description of the Related Art

In this patent the term "artillery projectile" means a projectile configured to be launched from an artillery piece. An "artillery piece", in turn, means a weapon that launches or fires a projectile by means of the combustion of a propellant charge within a tubular barrel. Artillery pieces include fixed artillery, mobile artillery, guns mounted on vehicles such as tanks, and navel guns, but not, for example, rocket launchers.

The effectiveness of a conventional artillery projectile may be limited by a variety of constraints. Two such constraints are range and accuracy. For instance, an artillery projectile may have a limited range relating to a maximum muzzle velocity for a given combination of projectile, barrel, and propellant. Targets beyond this limited range cannot be effectively reached. Additionally, an artillery projectile may have a fixed trajectory upon firing. As a consequence, an unguided artillery projectile that is not accurately aligned upon firing may miss its intended target. Other factors can reduce the accuracy of the unguided artillery projectile, such as atmospheric conditions, variations in the aerodynamic properties of a given projectile, variations in the artillery piece that fires the projectile, and other factors.

A number of artillery projectile systems have been developed to overcome these limits on conventional artillery projectiles. For instance, rocket assisted artillery-fired artillery projectiles, such as the M549A1 rocket assisted artillery projectile, include an integral rocket motor to increase range. While the propulsion of an integrated rocket motor may increase range, the incorporation of a rocket motor may reduce accuracy.

Highly accurate guided artillery projectiles, such as the Excalibur projectile, have also been developed. Such guided artillery projectiles typically include a guidance system and control surfaces for modifying the trajectory of the projectile. For example, current guided artillery projectiles may include deployable fins, canards, or other control devices that modify the aerodynamic properties of the projectile to affect its trajectory. The guidance system, the deployable control surfaces, and the motors or other actuators for the control surfaces greatly increase the cost and complexity of such a guided artillery projectile. Additionally, the inherent drag of the aerodynamic control surfaces may reduce the range of the projectile.

Throughout this description, elements appearing in figures are assigned three-digit reference designators, where the most significant digit is the figure number where the element first appeared and the two least significant digits are specific to the element. An element that is not described in conjunction with a figure may be presumed to have the same characteristics and function as a previously-described element having the same reference designator.

DETAILED DESCRIPTION

Figure 1:
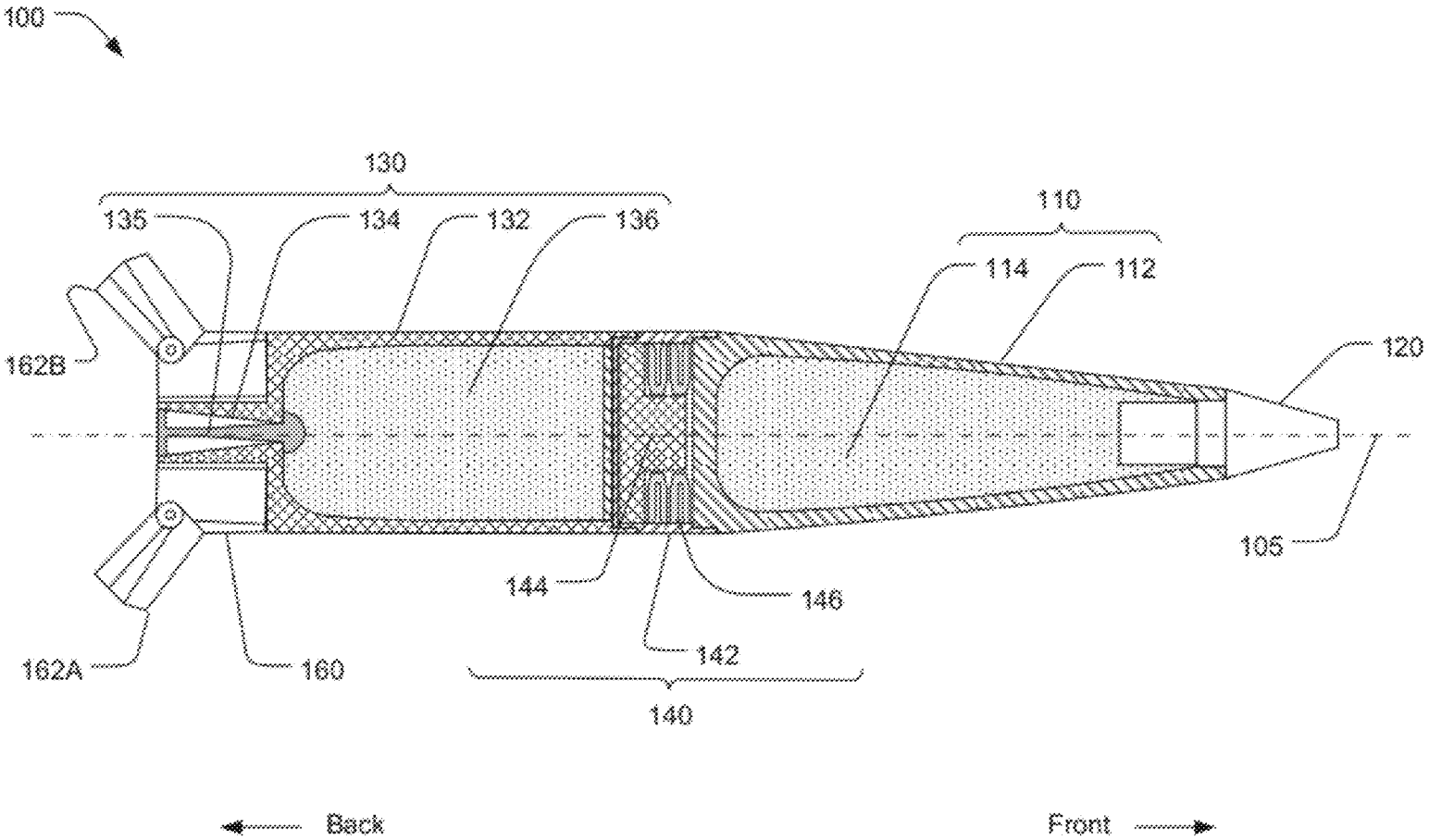
FIG. 1 is a schematic cross-sectional view of a modular guided artillery projectile.
Figure 2:
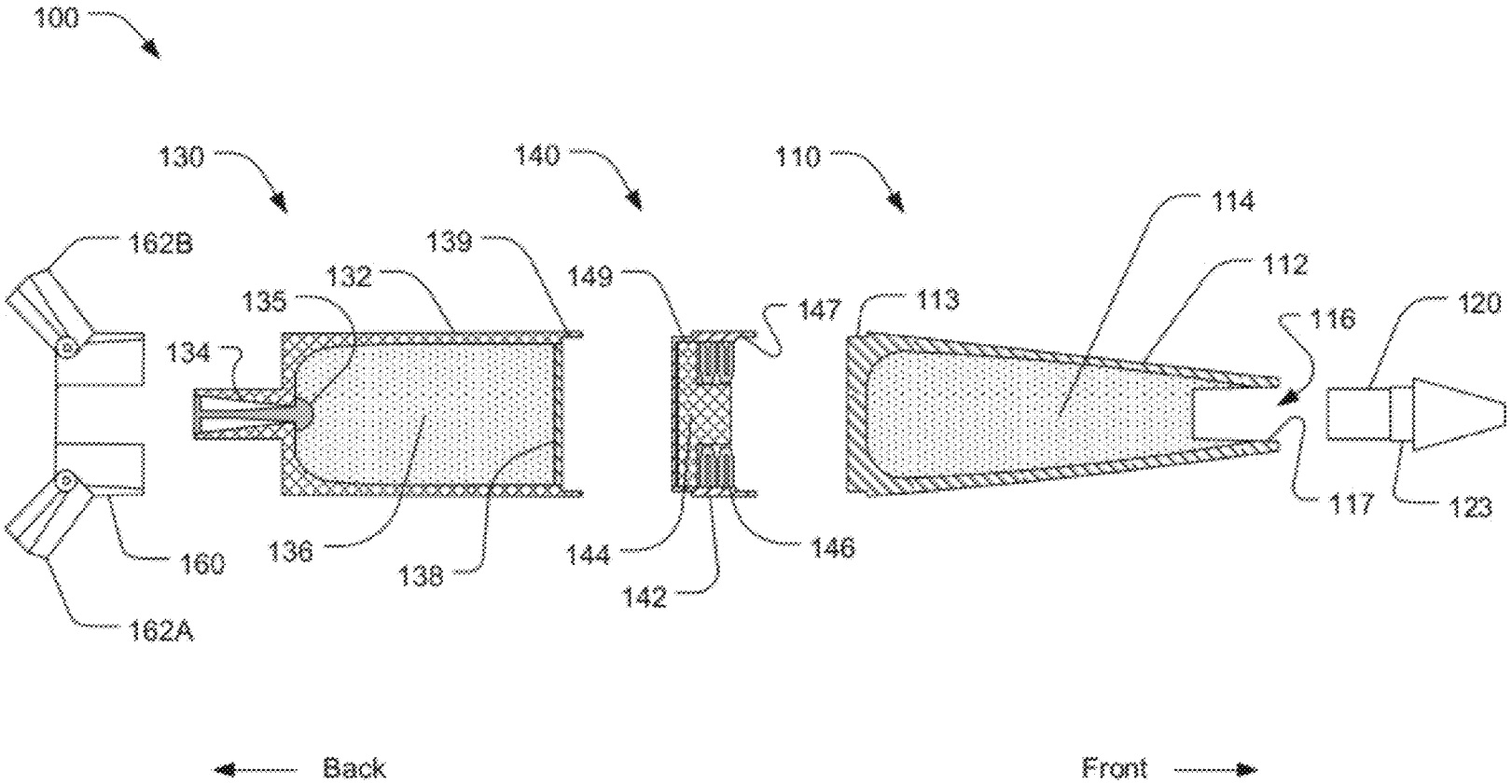
FIG. 2 is a schematic cross-sectional exploded view of the modular guided artillery projectile of FIG. 1.

FIG. 1 shows a cross-sectional view and FIG. 2 shows an exploded cross-sectional view of an exemplary modular guided artillery projectile 100. The modular guided artillery projectile 100 may include a payload module 110, a guidance module 140, and a rear module which, in this example, is a propulsion module 130. Each of the payload module 110, the guidance module 140, and the propulsion module 130 may have a respective front and back end. The back end of the payload module, both the front and back ends of the guidance module, and the front end of the propulsion module may have respective mechanical interfaces, such that back end of the payload module 110 may be mechanically coupled to the front end of the guidance module 140, and the back end of the guidance module 140 may be mechanically coupled to the front end of the propulsion module 130. Except for the mechanical coupling between adjacent modules 110, 140, 130, there may be no electrical, optical, hydraulic, or other connection between the payload module 110, the guidance module 140, and the propulsion module 130.

The payload module 110 may be, or may be adapted from, a conventional artillery projectile payload. The payload module 110 may include a payload case 112 filled with a payload 114. The payload 114 may be a conventional explosive, an unconventional explosive such as nuclear material, a chemical agent, a biological agent, and/or a smoke generating material. The payload 114 may be a deployable cargo such as antipersonnel grenades or antitank mines.

The payload module 110 may include a fuze well 116 to accept an artillery fuze 120. The fuze 120 may be configured to detonate the payload 114 in close proximity to an intended target. The fuze 120 may have a threaded portion 123 to engage with a complementary threaded portion 117 of the fuze well 116. The fuze 120 may normally be stored separately from the artillery projectile 100 and may be assembled to the artillery projectile 100 immediately before the artillery projectile 100 is loaded into an artillery piece for firing.

The payload module 110 may be one of a plurality of mechanically interchangeable payload modules having different payloads and/or fuzes. Two payload modules are considered as "mechanically interchangeable" if both payload modules provide substantially the same mechanical interface for coupling the guidance module 140, and if the resulting projectiles can be fired from the same artillery piece. Similarly, two projectiles are considered to be mechanically interchangeable if they can be fired form the same artillery piece. In this context "substantially the same" means identical in form and function within normal manufacturing tolerances, but not necessarily identical in material or construction. Mechanically interchangeable payload modules and artillery projectiles may not be the same physical size or shape. The payload module 110 and the guidance module 140 may be detachably coupled such that different payload modules may be installed or exchanged at a manufacturer's facility, in a military depot, or in a field environment.

The guidance module 140 may include a guidance module case 142. The front end of the guidance module case 142 may include a mechanical interface configured to couple to a mating mechanical interface included at the back end of the payload case 112. The guidance module case 142 may include, for example, a threaded portion 147 to engage with a complementary threaded portion 113 of the payload case 112. The guidance module case 142 may be mechanically coupled to the payload case 112 by some other form of mechanical interface. The back end of the guidance module case 142 may include a mechanical interface configured to a mating mechanical interface included at the front end of a rocket motor case 132. The guidance module case 142 may include, for example, a threaded portion 149 to engage with a complementary threaded portion 139 of the rocket motor case 132. The guidance module case 142 may be mechanically coupled to the rocket motor case 132 via some other form of mechanical interface.

The guidance module 140 may contain a guidance system 144 and a plurality of transverse thrusters 146. Each transverse thruster may be a miniature rocket motor configured to generate a thrust or force generally transverse to a longitudinal axis 105 of the artillery projectile 100. The number, properties, and arrangement of the transverse thrusters 146 may be configured in any suitable form. For example, the plurality of transverse thrusters 146 may be disposed in multiple circumferential rows about the guidance module 140, with the thrusters in each row arranged radially and at equal angular separations, with respect to the longitudinal axis 105 of the guided artillery projectile 100. The plurality of transverse thrusters 146 may be disposed in proximity to the center of mass of the guided artillery projectile 100 such that actuation of one or more of the thrusters generates a force transverse to the longitudinal axis 105 but substantially no torque about the center of mass.

The guidance system 144 may be configured to receive an intended destination prior to the launch of the artillery projectile 100. The guidance system 144 may include a navigation system (not shown) to determine an instantaneous position of the artillery projectile 100. The navigation system may be, for example a GPS receiver. The guidance system 144 may include a processor (not shown) that determines a trajectory, including an anticipated trajectory end point, based on a series of instantaneous position measurements from the navigation system. The guidance system 144 may selectively cause one or more of the transverse thrusters 146 to fire to alter the trajectory of the artillery projectile 100 such that the anticipated trajectory end point converges on the intended destination.

For example, if the guidance system 144 determines that the anticipated trajectory end point is to the right of the intended destination, the guidance system 144 may cause one or more of the transverse thrusters 146 to fire to generate a force pushing the projectile to the left. In order to generate a force pushing the projectile to the left, the guidance system 144 must fire a transverse thruster that is pointing to the right. Since the artillery projectile 100 may roll continuously about the longitudinal axis 105, the guidance system 144 may include a roll sensor subsystem (not shown) to determine the instantaneous roll orientation of the artillery projectile 100. The roll position subsystem may include, for example, an inertial measurement unit and a processor to generate an instantaneous roll orientation estimate.

The propulsion module 130 may be, or may be adapted from, a conventional rocket-assisted artillery projectile motor. For example, the propulsion module 130 may be, or may be adapted from the M549A1 rocket motor. The propulsion module 130 may include a rocket motor case 132 containing an ignitable propellant material 136. A forward portion of the rocket motor case 132 may include or be a thermal insulator 138 to isolate the guidance module 140 from the heat of burning propellant material. The propellant material 136, when ignited, may produce combustion gases that may be exhausted from the rocket motor through a nozzle 134 to produce thrust. For example, the propellant material 136 may comprise a HTPB/AP propellant or other propellant material.

A delayed igniter 135 may be disposed in the nozzle 134. The delayed igniter may be, for example, the igniter from the M549A1 rocket motor. When the artillery projectile 100 is launched from a gun barrel, a back portion of the igniter 135 may be ignited by the combustion of the gun propellant charge in the gun barrel. The igniter 135 may then burn for a predetermined period of time before igniting the rocket motor propellant 136. The predetermined period of time may be selected, for example, to allow the projectile to travel a sufficient distance to protect the gun crew from the ejected rocket motor ignitor plug. For example, the igniter from the M549A1 rocket motor may ignite the rocket motor approximately seven seconds after the projectile is launched.

A base 160 may be attached to the propulsion module 130. The base 160 may support a plurality of fins such as fins 162A, 162B. While only two fins are visible in FIG. 1A and FIG. 1B, the base 160 may support more than two fins. The fins 162A, 162B may be folded within the outline of the base 160 prior to the launch of the artillery projectile 100. The fins 162A, 162B may deploy or extend upon, or shortly after, launch. The fins 162A, 162B may be effective to stabilize the flight of the artillery projectile 100 after launch. The fins 162A, 162B may also be effective to slow a roll rate of the projectile when the projectile is launched from a rifled gun barrel or to introduce a stable roll rate when the projectile is launched from an unrifled barrel.

Figure 3:
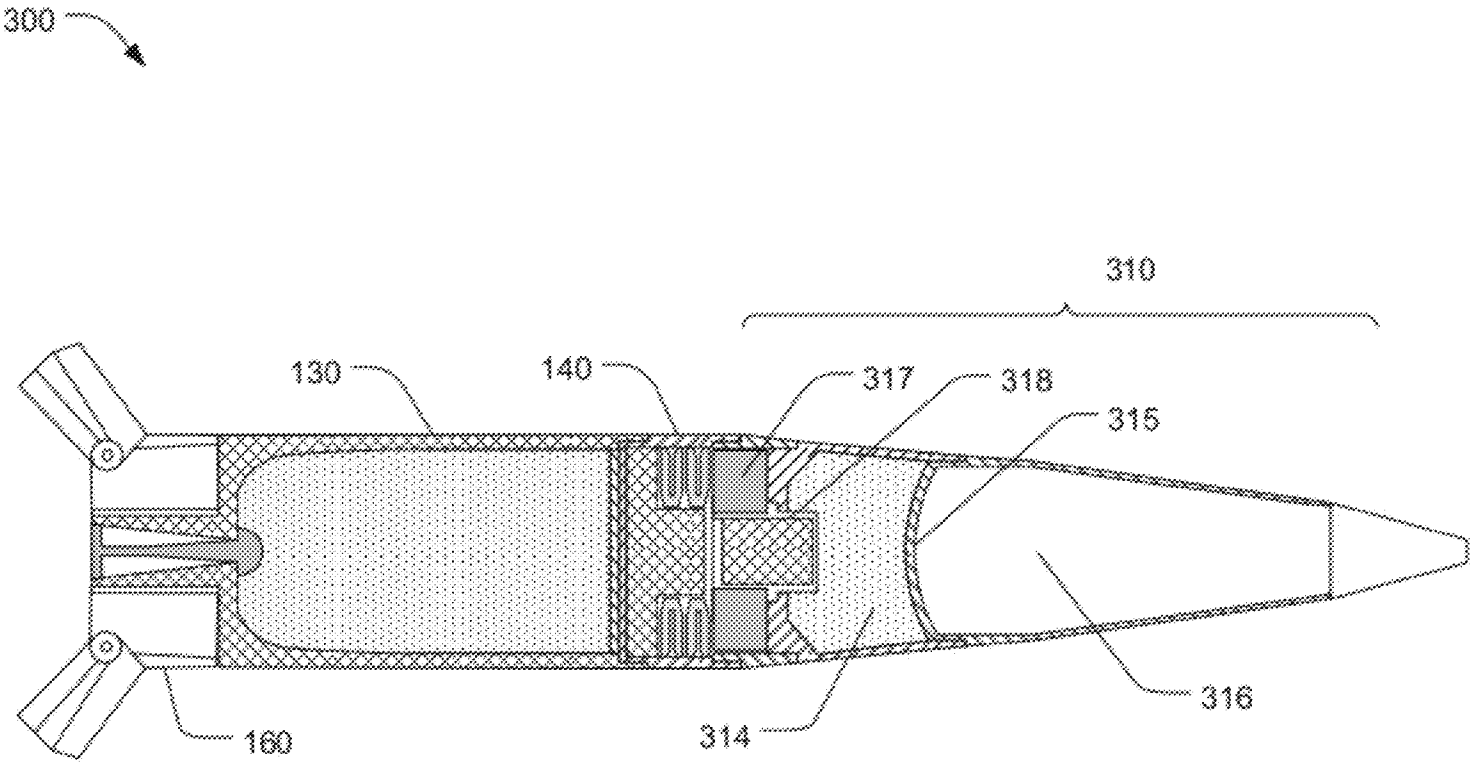
FIG. 3 is a schematic cross-sectional view of a modular artillery projectile having an intelligent payload module.

The modular guided artillery projectile 100 may be part of a modular guided artillery projectile system that allows one or more portion of the projectile, such as the payload module, to be selected from a plurality of interchangeable modules. By selecting an appropriate combination of interchangeable modules, a modular guided artillery projectile may be adapted to different mission requirements. As an example of the flexibility of the modular guided artillery projectile system, FIG. 3 shows a modular guided artillery projectile 300 including the guidance module 140, propulsion module 130, and base 160 as previously described, in combination with an intelligent payload module 310. The intelligent payload module 310 may be mechanically interchangeable with the payload module 110 shown in FIG. 1 and FIG. 2. The intelligent payload module 310 may include a deceleration device 317 such as a parachute, a positioning system 318, and an explosively formed penetrator (EFP) warhead 314/315/316.

The intelligent payload module 310 may be similar in function to a XM898 SADARM (search and destroy armor) warhead. When the artillery projectile 300 has been guided to a target region by the guidance module 140, the intelligent payload module 310 may detach from the artillery projectile 300 and deploy the deceleration device 317. As the intelligent warhead 310 gradually descends, the positioning system 318 may position the intelligent payload module 310 directly over an armored vehicle target. The EFP warhead may include an explosive charge 314, an EFP liner 315, and an empty volume 316. When the explosive charge 314 is detonated, the EFP liner may be formed into a hypervelocity projectile directed down onto the top of the target.

Figure 4:
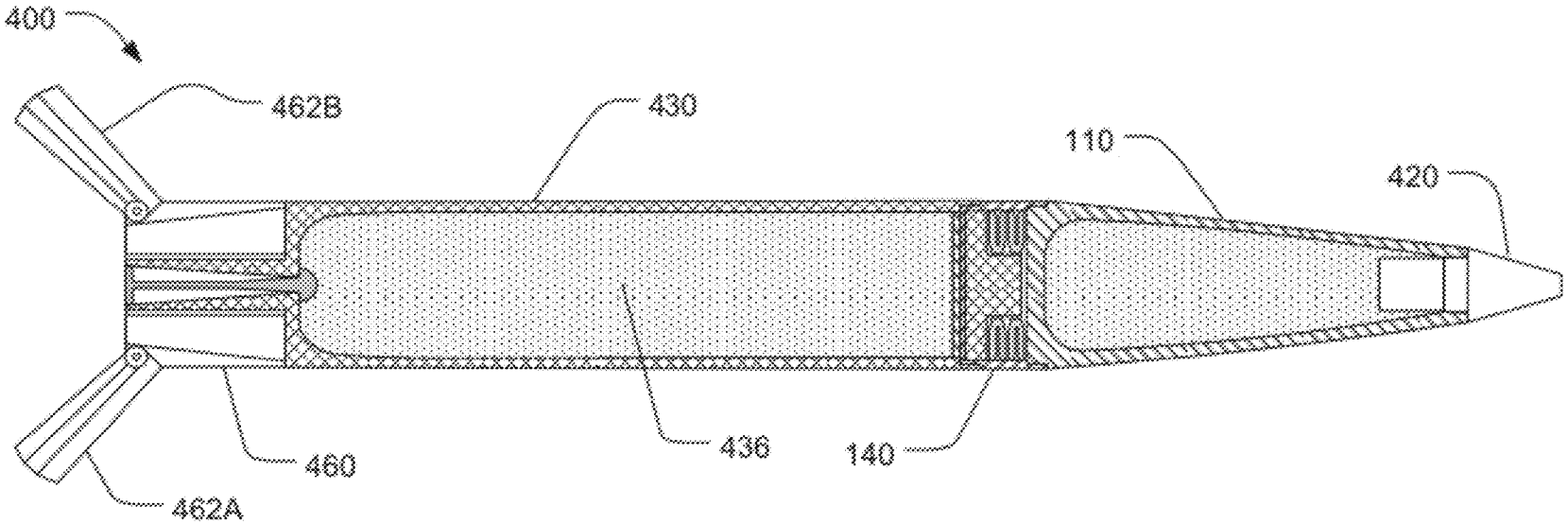
FIG. 4 is a schematic cross-sectional view of a modular unguided artillery projectile.

Referring now to FIG. 4, another exemplary modular guided artillery projectile 400 may include the payload module 110 and guidance module 140 as previously described and an extended-range propulsion unit 430. The payload module 110 may be one of a family of mechanically interchangeable payload modules. The extended-range propulsion module 430 may contain a substantially larger quantity of propellant material 436 than the propulsion module 130. The additional thrust provided by combustion of the larger quantity of propellant material may provide the artillery projectile 400 with substantially longer range than the artillery projectile 100. The artillery projectile 400 may include a base 460 which deploys fins such as fins 462A, 462B. The fins 462A, 462B may be configured to stabilize the flight of the extended-length artillery projectile 400. The fins 462A, 462B may be longer or otherwise larger than the fins 162A, 162B of the artillery projectile 100.

The artillery projectile 400 may not be mechanically interchangeable with the artillery projectile 100. The artillery projectile 400 may be adapted to be launched from an artillery piece, such as a naval gun, compatible with the extended length of the artillery projectile 400. The artillery projectile 100 may be launched from a conventional artillery piece, which is to say an artillery piece other than a naval gun.

Figure 5:
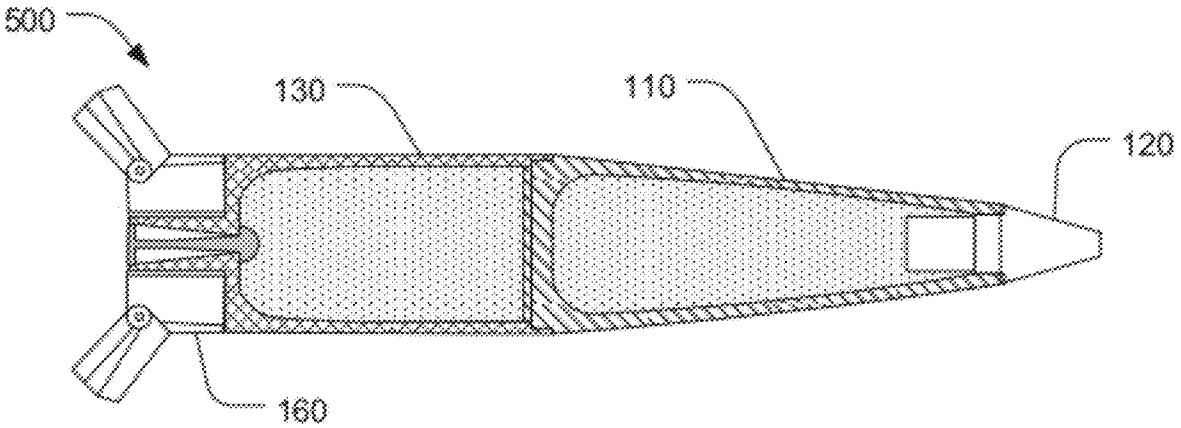
FIG. 5 is a schematic cross-sectional view of another modular guided artillery projectile.

The number of unguided artillery projectiles purchased and expended during training and combat may greatly exceed the number of guided artillery projectiles. Thus the cost of modular guided artillery projectiles, such as the artillery projectiles 100, 200, 300, and 400 may be reduced by economies of scale if at least some of the modules are incorporated into unguided artillery projectiles. For example, FIG. 5 shows a schematic cross-sectional view of a modular unguided artillery projectile 500 including the payload module 110, fuze 120, propulsion module 130, and base 160 from the guided artillery projectile 100 as shown in FIG. 1 and FIG. 2. The payload module 110 may be one of a family of mechanically interchangeable payload modules. The modular unguided artillery projectile 500 is essentially the same as the modular guided artillery projectile 100 except that the guidance unit 140 is omitted and the back of the payload module is coupled to the front of the propulsion module. When fins are not necessary to ensure the stability of a projectile, an unguided artillery projectile may include an alternate base (not shown) without fins. An extended range unguided projectile, suitable for firing from a naval gun, may be provided by combining a payload module with the extended-range propellant module 430.

Referring back to FIG. 2, to allow the components of the module guided artillery projectile 100 to be assembled into the unguided artillery projectile 500, the mechanical interface at the front of the propulsion module and the mechanical interface at the front of the guidance module may be substantially the same. Similarly, the mechanical interface at the back of the payload module and the mechanical interface at the back of the guidance module may be substantially the same. For example, the threaded portion 139 at the front of the propulsion module 130 may be the same as the threaded portion 147 at the front of the guidance module 140, and the threaded portion 113 at the back of the payload module 110 may be the same as the threaded portion 149 at the back of the guidance module 140. Alternatively, a propulsion module and a payload module may be coupled using an adapter ring (not shown) in lieu of a guidance module.

Figure 6:
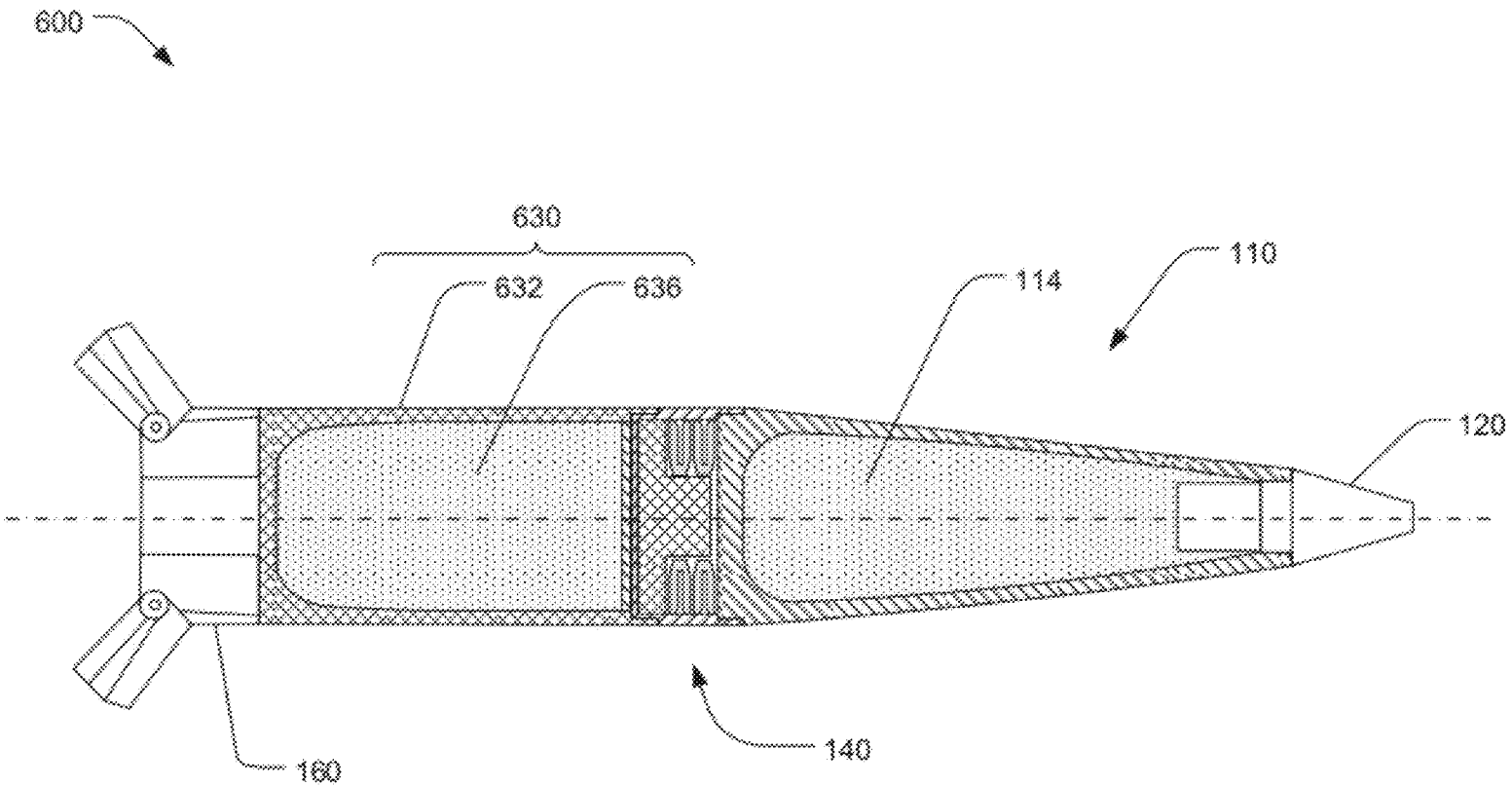
FIG. 6 is a schematic cross-sectional view of another modular guided artillery projectile.

In situations where the extended range of a rocket-propelled artillery projectile is not required, the rear module of a guided or unguided projectile may be an auxiliary payload module rather than a propulsion module, Referring now to FIG. 6, a modular guided artillery projectile 600 may include a payload module 110 with fuze 120, a guidance module 140, a base 160, and an auxiliary payload module 630 instead of a propulsion module. The auxiliary payload module 630 may include a case 632 and a payload 636. The auxiliary payload module 630 may be mechanically interchangeable with the propulsion module 130. The payload 636 may be a conventional explosive, an unconventional explosive such as nuclear material, a chemical agent, a biological agent, and/or a smoke generating material. The payload 636 may be a cargo such as antipersonnel grenades or antitank mines. The payload 636 may be the same as or different from the payload 114 within the payload module 110. The auxiliary payload module 630 may include a fuze (not shown), or may be configured to detonate or otherwise deploy the payload 636 in response to the detonation or deployment of the payload 114.

The payload module 110 may be directly coupled to the auxiliary payload module 630 (without a guidance module) to form a high payload capacity unguided artillery projectile (not shown). In situations where the extended range of a rocket-propelled artillery projectile is not required and extra payload capacity is not required, the auxiliary payload module may be empty or filled with an inert substance to provide the appropriate weight and balance for the artillery projectile.

Description of Processes

Figure 7:
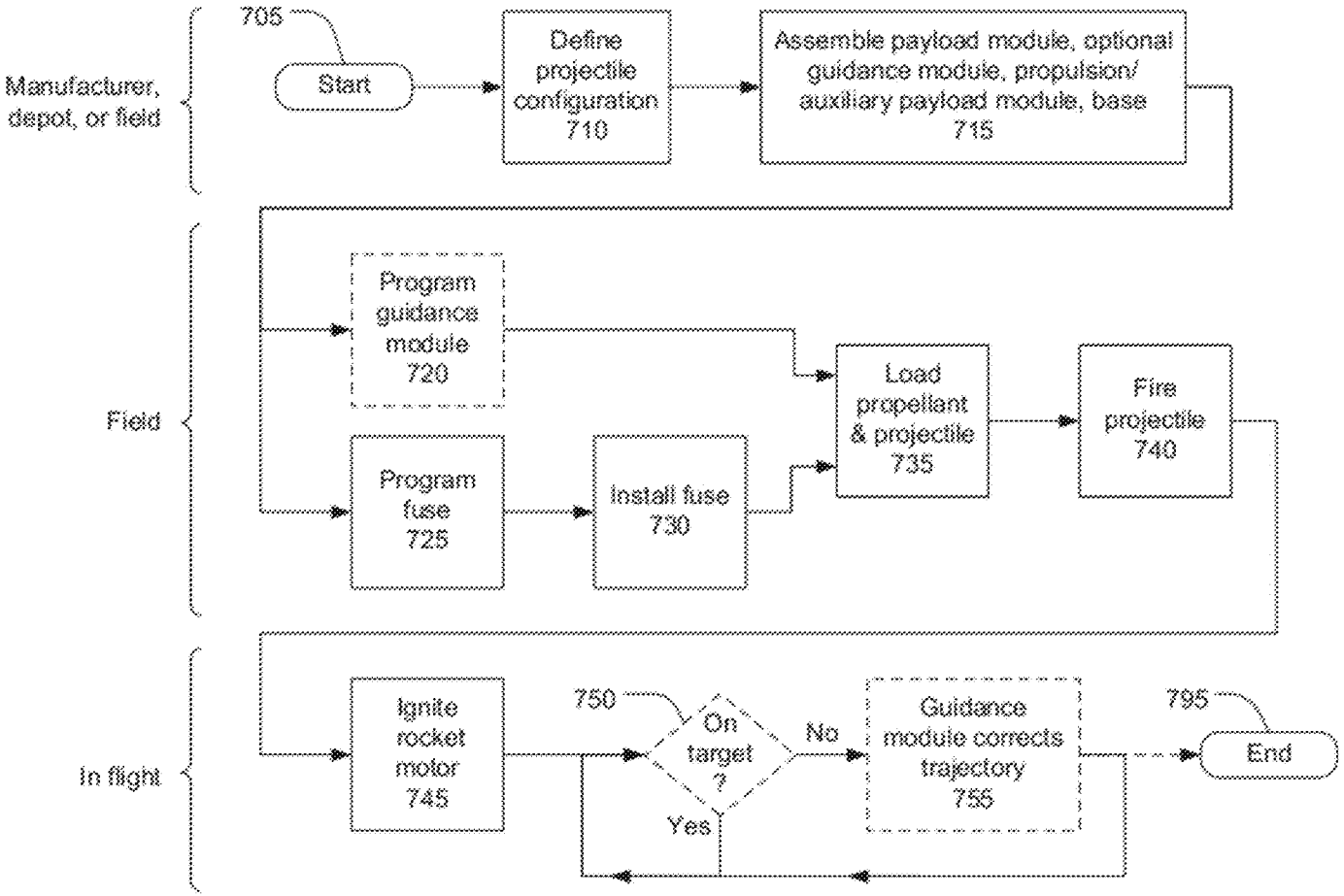
FIG. 7 is a flow chart of a method of engaging a target.

Referring now to FIG. 7, a method of engaging a target 700 may start at 705, when a decision to engage a known or anticipated target is reached, and may conclude at 795 when an artillery projectile engages the target. At 710, the artillery projectile configuration may be defined based on known or anticipated engagement parameters such range to the target, the nature of the target (armored vehicle, personnel, structure, etc.), weather, rules of engagement, and other parameters. Defining the artillery projectile configuration may include selecting a payload module from a plurality of interchangeable payload modules which may include payload modules containing conventional explosives, unconventional explosives such as nuclear material, intelligent payloads, chemical agents, biological agents, smoke generating material, and deployable cargo such as antipersonnel grenades or antitank mines. Defining the artillery projectile configuration may also include selecting either a propulsion module or an auxiliary payload module. Defining the artillery projectile configuration at 710 may also include selecting an appropriate projectile base (with or without fins) as appropriate to the artillery projectile configuration and the artillery piece (rifled or unrifled) to be used to launch the artillery projectile. Defining the artillery projectile configuration may include determining whether or not the engagement requires precision delivery of the payload and thus whether or not a guidance module will be included in the projectile. When a guidance module is included in the projectile assembled at 715, actions at 720, 750, and 755 (shown in dashed boxes) may be subsequently performed. When a guidance module is not included in the projectile, the actions at 720, 750, and 755 will not be performed.

The artillery projectile defined at 710 may be assembled at 715.

Defining a artillery projectile configuration at 710 and assembling the artillery projectile at 715 may be performed by a manufacturer or at a weapons depot in anticipation of a future requirement to engage a target. Alternatively, the actions at 710 and 715 may be performed in the field prior to engaging a specific target. The term "in the field" is intended to encompass both training and combat situations.

When the artillery projectile assembled at 715 includes a guidance module, the guidance module may be programmed at 720. Programming the guidance module may be or included providing a location, for example in terms of GPS coordinates, to the guidance module. The guidance module may be programmed by means of a wired or wireless communications link between the guidance module and a controller external to the artillery projectile.

A suitable fuze may be programmed at 725 and installed in the artillery projectile at 730. Typically, the fuze may be installed in the artillery projectile shortly before the artillery projectile is loaded and fired. The fuze may be programmed by means of a wired or wireless communications link between the fuze and a controller external to the artillery projectile.

The completed artillery projectile, including the fuze from 730, may be loaded into a suitable artillery piece at 735 and fired towards a target at 740.

When the artillery projectile assembled at 715 and fired at 740 includes a propulsion module, a rocket motor within the propulsion module may be ignited at 745. Typically, the propulsion module may be ignited shortly after the artillery projectile exits the artillery piece. For example, the rocket motor may be ignited by a delayed fuze as previously described.

When the artillery projectile assembled at 715 and fired at 740 includes a guidance module, the guidance module may guide the flight of the artillery projectile at 750 and 755. At 750, the guidance module may determine if the artillery projectile is "on target", which is to say that the artillery projectile is following a trajectory that will terminate at or near a target location programmed into the guidance module at 720. The artillery projectile trajectory may be determined, for example, by repetitive GPS position measurements, from an inertial navigation system, or through a combination of GPS with inertial measurements and/or other sensors designed to aid navigation of the projectile. When the artillery projectile is not on target, the guidance module may correct the trajectory of the artillery projectile by firing one or more transverse thrusters at 755. Although 750 and 755 are shown as consecutive actions for ease of explanation, these actions may be performed continuously and in parallel to provide real-time guidance of the artillery projectile to the target.

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. A modular artillery projectile, comprising:

a payload module selected from a plurality of interchangeable payload modules containing different payloads, a guidance module coupled to the payload module, and a rear module coupled to the guidance module;

wherein the guidance module comprises:

a transverse propulsion system configured to propel the modular guided artillery projectile transversely to a longitudinal axis of the artillery projectile, a global positioning system receiver, and a control system to control the transverse propulsion system responsive to the global positioning system receiver to guide the artillery projectile to a predetermined target position; wherein each of the plurality of interchangeable payload modules comprises a first threaded mechanical interface, the guidance module comprises a second threaded mechanical interface coupled to the first threaded mechanical interface of the payload module and a third threaded mechanical interface substantially the same as the first threaded mechanical interface, and the rear module comprises a fourth threaded mechanical interface coupled to the third threaded mechanical interface, the fourth threaded mechanical interface substantially the same as the second mechanical interface.

2. The modular artillery projectile of claim 1, wherein each of the plurality of interchangeable payload modules are configured to be directly coupled to a rear module to provide an unguided artillery projectile.

3. The modular artillery projectile of claim 1, wherein the plurality of interchangeable payload modules includes at least two of a module having a conventional explosive payload, a module having an unconventional explosive payload, a module having an intelligent payload, a module having a chemical agent payload, a module having a biological agent payload, a module having a smoke generating payload, and a module having a deployable cargo payload.

4. The modular artillery projectile of claim 1, wherein the rear module is an auxiliary payload module.

5. The modular artillery projectile of claim 1, wherein the rear module is a propulsion module.

6. The modular artillery projectile of claim 5, wherein the propulsion module is selected from the group consisting of a propulsion module configured for firing from a conventional artillery piece and an extended range propulsion module configured for firing from a naval gun.

7. The modular artillery projectile of claim 5, wherein the propulsion module comprises a delayed ignitor configured to be ignited as the artillery projectile is fired from an artillery piece.

8. The module artillery projectile of claim 1, further comprising a base coupled to the rear module.

9. The modular artillery projectile of claim 8, wherein the base is configured to deploy fins after the modular projectile is fired from an artillery piece.

10. A method of engaging a target, comprising:

defining an artillery projectile configuration based on engagement parameters;

assembling the artillery projectile in accordance with the defined configuration, the artillery projectile including a payload module selected from a plurality of interchangeable payload modules carrying different payloads, a guidance module coupled to the payload module, said guidance module comprising a transverse propulsion system configured to propel the modular guided artillery projectile transversely to a longitudinal axis of the artillery projectile, a global positioning receiver, and a control system to control the transverse propulsion system responsive to the global positioning system receiver to guide the artillery projectile to a predetermined target position, and a rear module coupled to the guidance module;

each of the plurality of interchangeable payload modules comprises a first threaded mechanical interface, the guidance module comprises a second threaded mechanical interface coupled to the first threaded mechanical interface of the payload module and a third threaded mechanical interface substantially the same as the first threaded mechanical interface, and the rear module comprises a fourth threaded mechanical interface coupled to the third threaded mechanical interface, the fourth threaded mechanical interface substantially the same as the second mechanical interface;

programming a target location into the guidance module of the artillery projectile;

firing the programmed artillery projectile from an artillery piece; and the guidance module guiding the projectile to the programmed target location.

11. The method of engaging a target of claim 10, wherein the plurality of interchangeable payload modules includes at least two of a module having a conventional explosive payload, a module having an unconventional explosive payload, a module having an intelligent payload, a module having a chemical agent payload, a module having a biological agent payload, a module having a smoke generating payload, and a module having a deployable cargo payload.

12. The method of engaging a target of claim 10, wherein the rear module is one of a propulsion module and an auxiliary payload module.

13. The method of engaging a target of claim 10, wherein the projectile comprises a fuze, the method further comprising installing and programming the fuze prior to firing the projectile.

14. The method of engaging a target of claim 13, wherein the transverse propulsion system comprises one or more lateral thrusters configured to propel the projection transversely to a longitudinal axis of the projectile, and controlling the transverse propulsion system comprises firing at least one of the lateral thrusters.

15. The method of engaging a target of claim 10, wherein the guidance module guiding the projectile to the programmed target location further comprises:

determining a current projectile trajectory based on, at least in part, plural projectile position measurements from a GPS receiver included in the guidance module; and when the current projectile trajectory does not terminate at the programmed target location, controlling a transverse propulsion system to correct the projectile trajectory.

16. A method of assembling a modular artillery projectile, comprising:

defining an artillery projectile configuration based on engagement parameters;

providing a payload module selected from a plurality of interchangeable payload modules carrying different payloads, each of the plurality of interchangeable payload modules comprises a first threaded mechanical interface, providing a guidance module comprising a second threaded mechanical interface and a third threaded mechanical interface substantially the same as the first threaded mechanical interface, said guidance module comprising a transverse propulsion system configured to propel the modular guided artillery projectile transversely to a longitudinal axis of the artillery projectile, a global positioning receiver, and a control system to control the transverse propulsion system responsive to the global positioning system receiver to guide the artillery projectile to a predetermined target position, providing a rear module comprising a fourth threaded mechanical interface substantially the same as the second mechanical interface, and assembling the artillery projectile in accordance with the defined configuration by coupling the guidance module's second threaded mechanical interface to the payload modules' first threaded mechanical interface and coupling the rear module's fourth threaded mechanical interface to the guidance module's third threaded mechanical interface.

* * * * *